US006277535B1

(12) United States Patent
Liu et al.

(10) Patent No.: US 6,277,535 B1
(45) Date of Patent: Aug. 21, 2001

(54) UNDERCOATING LAYER FOR IMAGING MEMBER

(75) Inventors: Ping Liu; Yu Qi; Beng S. Ong; Cheng-Kuo Hsiao, all of Mississauga (CA); Helen R. Cherniack, Rochester; Huoy-Jen Yuh, Pittsford, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/549,612

(22) Filed: Apr. 14, 2000

(51) Int. Cl.[7] ..... G03G 5/14

(52) U.S. Cl. ..... 430/64; 430/131

(58) Field of Search ..... 430/64, 60, 131

(56) References Cited

U.S. PATENT DOCUMENTS

| | | | | |
|---|---|---|---|---|
| 4,265,990 | | 5/1981 | Stolka et al. . | |
| 4,298,697 | | 11/1981 | Baczek et al. . | |
| 4,338,390 | | 7/1982 | Lu . | |
| 4,560,635 | | 12/1985 | Hoffend et al. . | |
| 5,385,796 | * | 1/1995 | Spiewak et al. | 430/64 |
| 5,688,621 | * | 11/1997 | Takegawa et al. | 430/64 |
| 5,789,127 | * | 8/1998 | Yamaguchi et al. | 430/64 |
| 5,891,594 | | 4/1999 | Yuh et al. . | |
| 5,958,638 | | 9/1999 | Katayama et al. . | |

* cited by examiner

*Primary Examiner*—Christopher Rodee
(74) *Attorney, Agent, or Firm*—Oliff & Berridge, PLC

(57) ABSTRACT

An electrophotographic imaging member includes a supporting substrate, an undercoating layer, an optional adhesive layer, a photogenerating layer, and a charge transporting layer. The undercoating layer is derived from the reaction of a silyl-functionalyzed polymer (III) with a silane coupling agent (I) and an optional silane coupling agent (II):

$$(RO)_3Si—A—Si(OR)_3 \quad (I)$$

(II)

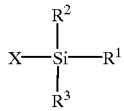

(III)

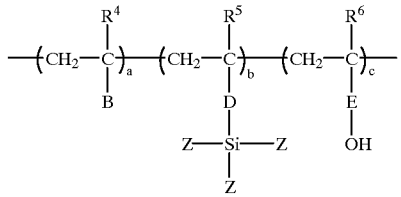

where R is alkyl, substituted alkyl, aryl, or substituted aryl, acyl, and the like; A is selected from alkylene, arylene, and alkylenearyl; X is alkyl, substituted alkyl, aryl, or substituted aryl; $R^1$, $R^2$, and $R^3$ are independently selected from alkyl aryl, alkoxy, aryloxy, acyloxy, halide, cyano, amino, and the like; $R^4$, $R^5$, and $R^6$ are hydrogen and alkyl; Z is selected from chloride, bromide, iodine, cyano, alkoxy, and acyloxy; B is preferably selected from halide, cyano, aryl, alkoxycarbonyl, aryloxycarbonyl and the like; D and E are preferably selected from alkyleneoxycarbonyl, arylene, alkylenearyl, aryleneoxycarbonyl, and alkylenearyloxycarbonyl; a, b, and c are the mole fractions of the repeating units of the polymer such that a+b+c=1.

22 Claims, No Drawings

UNDERCOATING LAYER FOR IMAGING MEMBER

BACKGROUND OF THE INVENTION

1. Field of Invention

This invention is generally directed to imaging members for electrophotography. More specifically, this invention is directed to a multilayer imaging photoreceptor having a mechanically and electrically robust undercoating layer.

2. Description of Related Art

In electrophotography, an electrophotographic imaging member, also commonly referred to as a photoreceptor, containing a photoconductive layer on a conductive layer, is imaged by first uniformly electrostatically charging the surface. The substrate is then exposed to a pattern of activating electromagnetic radiation, such as light. The light or other electromagnetic radiation selectively dissipates the charge in the illuminated areas of the photoconductive insulating layer while leaving behind an electrostatic latent image in the non-illuminated areas. This electrostatic latent image may then be developed to form a visible image by depositing finely divided electrostatically charged marking particles, generally referred to as toner particles, on the surface of the photoconductive layer. The resulting visible image may then be transferred from the electrophotographic imaging member to a support such as paper. This image developing is repeated as many times as necessary with reusable photoconductive layers.

An electrophotographic imaging member may take one of many different forms. For example, layered photoresponsive imaging members are known in the art. U.S. Pat. No. 4,265,990, which is incorporated herein by reference in its entirety, describes an exemplary layered photoreceptor having separate photogenerating and charge transport layers. The photogenerating layer is capable of photogenerating holes and injecting the photogenerated holes into the charge transport layer.

More advanced photoreceptors contain highly specialized component layers. For example, a multilayered photoreceptor that can be employed in electrophotographic imaging systems can include a substrate, a charge blocking undercoating layer, a charge generating layer (including photogenerating material in a binder) over the undercoating layer, and a charge transport layer (including charge transport material in a binder). Additional layers such as an overcoating layer or layers can also be included.

The photoconductors currently used are susceptible to carrier injection from the substrate into the photosensitive layer such that the charge on the surface of the photoconductor may be microscopically dissipated or decayed. This can result in production of a defective image. The interposition of an undercoating layer between the substrate and the photosensitive layer has been suggested to overcome this problem, and improve the chargeability of the photoconductor and enhance adhering and coating properties of the photosensitive layer with respect to the substrate.

U.S. Pat. No. 5,958,638, which is incorporated herein by reference in its entirety, discloses known materials used for undercoat layers. For example, such materials have included a resin material alone, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide and copolymers containing two or more of repeated units of these resins. The resin materials further have included casein, gelatin, polyvinyl alcohol, ethyl cellulose, etc.

The undercoat layers are typically formed by a dip coating method. See, for example, U.S. Pat. No. 5,958,638 and U.S. Pat. No. 5,891,594.

In photoreceptors of the above type, the photogenerating material generates electrons and holes when subjected to light. In the case of a hole blocking undercoating layer, the undercoating layer prevents holes in the conductive ground plane from passing into the photogenerator from which they would be conducted to the photoreceptor surface, thus dissipating the surface charge of the photoconductor. The undercoating layer does permit electrons generated in the photogenerator to pass to the conductive ground plane, preventing an undesirably high electric field from building up across the generator upon repeated usage or cycling of the photoconductive imaging member.

SUMMARY OF THE INVENTION

Despite the above and other photoconductor and imaging member designs, a need continues to exist in the art for electrophotographic imaging members, and processes for making such imaging members, that provide improved operational performance. The present invention meets these needs.

This invention provides a crosslinked polysiloxane undercoating layer (UCL) derived from crosslinking a silyl-functionalized hydroxyalkyl acrylate and/or methacrylate polymer with silane coupling agents, bis(alkoxysilyl)alkane such as 1,2-bis (triethoxysilyl)ethane and/or bis (trialkoxysilyl)arene such as 1,4-bis(trimethoxysilyl) benzene and an optional aminoalkylalkoxysilane such as γ-aminopropylsilane, or an optional mixture of an alkylalkoxysilane such as methyltrimethoxysilane and a crosslinking catalyst such as triethylamine or acetic acid.

The present invention also provides a photoconductive imaging member having at least the following sequence of layers:

(A) a substrate;

(B) a charge blocking undercoating layer; and (C) a photosensitive component comprising a charge generating layer and a charge transport layer.

The photoconductive imaging member of the present invention may be utilized in an electrophotographic apparatus.

The present invention also provides a method of making a photoconductive imaging member that incorporates a crosslinked polysiloxane undercoating layer derived from crosslinking a silylfinctionalized hydroxyalkyl acrylate and/or methacrylate polymer with a silane coupling agent, bis (alkoxysilyl)alkane such as 1,2- bis(triethoxysilyl)ethane or bis(alkoxysilyl)arene such as 1,4-bis(trimethoxysilyl) benzene and an optional aminoalkyltrialkoxysilane such as γ-aminopropylsilane or an optional mixture of an alkylalkoxysilane such as methyltrimethoxysilane and a crosslinking catalyst such as triethylamine or acetic acid.

DETAILED DESCRIPTION OF PREFERRED EMBODIMENTS

In an exemplary embodiment of an electrophotographic imaging member in accordance with this invention, the imaging member includes a substrate; an undercoating layer formed on the substrate; and a photoconductor layer formed on the undercoating layer, comprising a photogenerating layer and a charge transport layer. Other optional layers such as an adhesive layer may also be included, as desired.

The undercoating layer is generally located between the substrate and the photosensitive layer, although additional layers may be present and located between these layers. According to the present invention, the undercoating layer is formed by crosslinking a silylfunctionalized hydroxyalkyl acrylate and/or methacrylate polymer with a silane coupling agent, bis(alkoxysilyl)alkane or bis(alkoxysilyl)arene and an optional aminoalkyltrialkoxysilane or an optional mixture of an alkylalkoxysilane and a crosslinking catalyst such as triethylamine or acetic acid. The present inventors have found that such materials provide a more readily crosslinkable composition that cures at a faster rate, providing a solvent resistant and mechanically robust undercoating layer. Thus, in embodiments of the present invention, the silane coupling agents, bis(alkoxysilyl)alkane and bis (trialkoxysilyl)arene can be represented by formula (I):

$$(RO)_3Si—A—Si(OR)_3 \quad (I)$$

wherein R is an alkyl, substituted alkyl, aryl, or substituted aryl, acyl, and the like, preferably containing from about 1 to 24 carbon atoms, or some range therebetween; and A is selected from the group of divalent linkages such as alkylene, arylene, and alkylenearyl, preferably containing from about 1 to 24 carbon atoms, or some range therebetween. The different "R"s are preferably the same, but in embodiments can be different, if desired.

Illustrative examples of bis(alkoxysilyl)alkanes include, but are not limited to, 1,2-bis(trimethoxylsilyl)ethane, 1,2-bis(triethoxysilyl)ethane, 1,3-bis(trimethoxysilyl)propane, 1,3-bis(triethoxysilyl)propane, 1,3-bis(trimethoxysilyl)-2,2-dimethylpropane, 1,3-bis(triethoxysilyl)-2,2-dimethylpropane, and the like; while illustrative examples of bis(alkoxysilyl)arene include, but are not limited to, 1,4-bis (trimethoxysilyl)benzene, 1,3-bis(trimethoxysilyl)benzene, 1,4-bis(triethoxysilyl)benzene, 1,3-bis(triethoxysilyl) benzene, and the like. Mixtures of these and/or other compounds can also be used.

Additionally, other optional silane coupling agents represented by formula (II) can also be added:

(II)

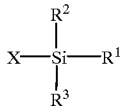

wherein X is alkyl, substituted alkyl, aryl, or substituted aryl; and $R^1$, $R^2$, and $R^3$ are independently selected from the group consisting of alkyl, aryl, alkoxy, aryloxy, acyloxy, halide, cyano, amino, and the like, provided that at least two of the $R^1$, $R^2$, and $R^3$ are selected from the group consisting of alkoxy, aryloxy, acyloxy, halide, cyano, and amino. The illustrative examples of such suitable silane agents according to formula (II) include, but are not limited to, methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, 3-aminopropyltriethoxysilane, and the like.

In embodiments of the present invention, the silylfunctionalyzed hydroxyalkyl acrylate or methacrylate polymer that is utilized for the preparation of the undercoating layer can be described by formula (III), which upon crosslinking reaction with silane coupling agent (I) and optionally in combination with silane coupling agent (II), provide a mechanically and electrically robust undercoating layer that enhances the photoreceptor electrical performance characteristics such as, for example, stable environmental and cyclic performance.

(III)

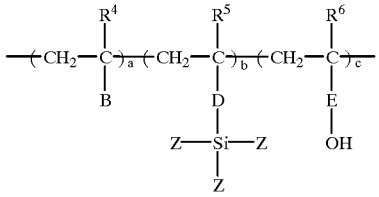

wherein $R^4$, $R^5$, and $R^6$ are independently selected from hydrogen and alkyl of, for example, about 1 to about 15 carbon atoms; Z is a hydrolyzable function selected from the group consisting of chloride, bromide, iodine, cyano, alkoxy of about 1 to about 5 carbon atoms, and acyloxy of from about 2 to about 5 carbon atoms; B is preferably selected from the group consisting of halide, such as bromide or chloride, cyano, aryl, alkoxycarbonyl, aryloxycarbonyl and the like, wherein alkoxy contains, for example, from 1 to about 6 carbon atoms and aryloxy contains, for example, from about 6 to about 15 carbon atoms; D and E are divalent linkages preferably independently selected from the group consisting of alkyleneoxycarbonyl of about 2 to about 10 carbon atoms, arylene of about 6 to about 15 carbon atoms, alkylenearyl of about 7 to about 15 carbon atoms, aryleneoxycarbonyl of from about 7 to about 15 carbon atoms, and alkylenearyloxycarbonyl of from about 8 to about 25 carbon atoms; a, b, and c are the mole fractions of the repeating units of the polymer, and wherein a ranges from about 0 to about 0.95, b ranges from about 0.001 to about 0.10, c ranges from 0.01 to 0.95, and wherein the sum of a+b+c is equal to 1. Preferably, a, b, and c are each in the range between 0.01 and 0.95, such that a+b+c=1.

In embodiments, polymer (III), which is utilized in the preparation of the undercoating layer of the present invention, is preferably selected from the group consisting of polymers (III-a) through (III-h):

(III-a)

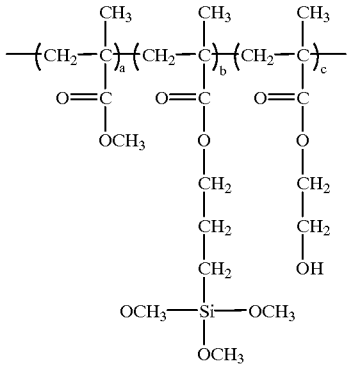

-continued (III-b)

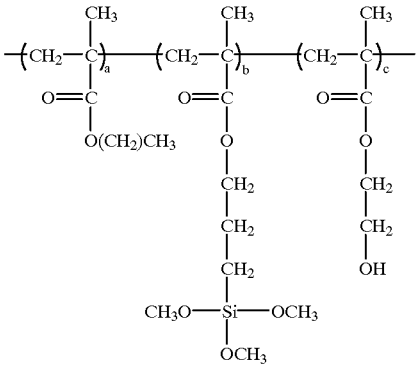

(III-c)

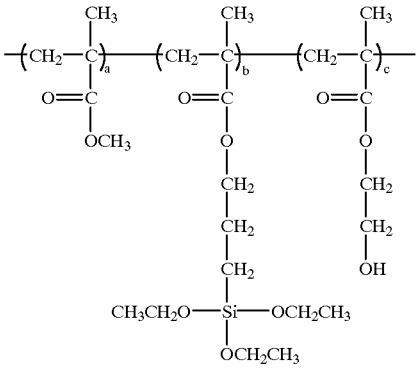

(III-d)

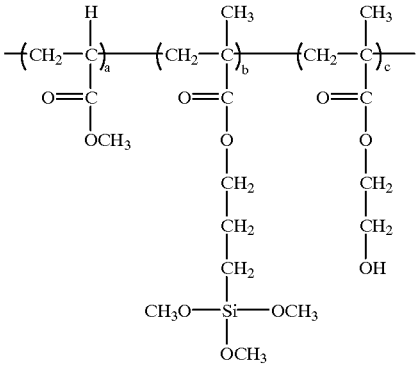

(III-e)

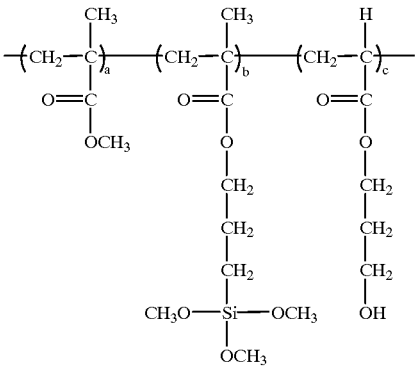

-continued (III-f)

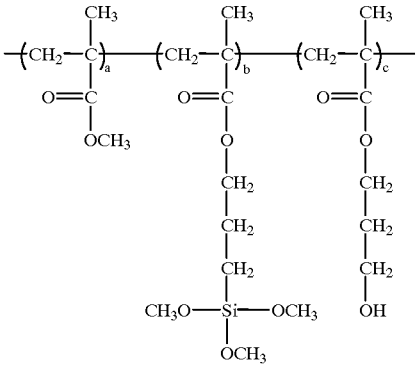

(III-g)

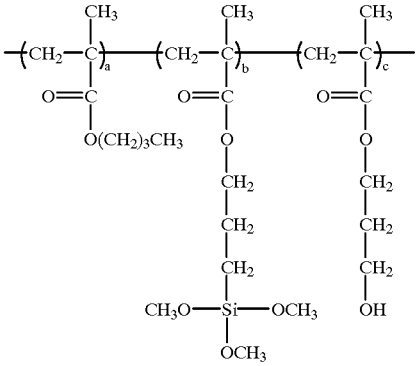

(III-h)

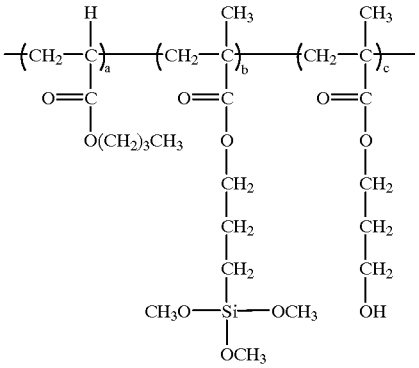

The structure of the photoconductive member according to the present invention can follow any of various known photoreceptor designs, modified to include the above-described undercoating layer. Because such photoreceptor designs are well known in the art, the remaining layers of the photoreceptor will be described only in brief detail for completeness.

In embodiments of this invention, a photoconductive imaging member comprises the following sequence of layers: a supporting substrate, a crosslinked undercoating layer, an adhesive layer, a photogenerating layer and a charge transport layer; a photoconductive imaging member wherein the adhesive layer is comprised of a polyester with an $M_w$ of from about 20,000 to about 100,000, and preferably about 35,000, and an $M_n$ of from about 10,000 to 50,000 preferably about 14,000.

Also, in embodiments of this invention, the supporting substrate can comprise a conductive metal substrate. In embodiments, the conductive substrate can be, for example, aluminum, aluminized or titanized polyethylene terephthalate belt (MYLAR®).

In embodiments, the photogenerator layer can have any suitable thickness, such as a thickness of from about 0.05 to about 10 microns. In embodiments, the transport layer can have a thickness of from about 10 to about 50 microns. In embodiments, the photogenerator layer can comprise photogenerating pigments dispersed in a resinous binder in an amount of from about 5 percent by weight to about 95 percent by weight. In embodiments, the resinous binder can be any suitable binder, such as selected from the group consisting of polyesters, polyvinyl butyrals, polycarbonates, polystyrene-b-polyvinyl pyridine, and polyvinyl formals.

In embodiments, the charge transport layer can comprise aryl amine molecules. In embodiments, the aryl amines can be of the following formula:

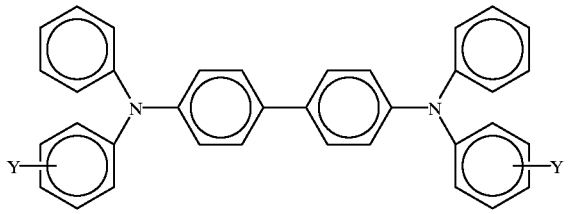

wherein Y selected from the group consisting of alkyl and halogen, and wherein the aryl amine is dispersed in a highly insulating and transparent resinous binder. In embodiments, the arylamine alkyl contains from about 1 to about 10 carbon atoms. In embodiments, the arylamine alkyl contains from 1 to about 5 carbon atoms. In embodiments, the arylamine alkyl is methyl, wherein halogen is chlorine, and wherein the resinous binder is selected from the group consisting of polycarbonates and polystyrenes. In embodiments, the aryl amine is N,N'-diphenyl-N,N-bis(3-methyl phenyl)-1,1'-biphenyl-4,4'-diamine.

In embodiments, the photoconductive imaging member can also include an adhesive layer of a polyester with an $M_w$ of preferably about 70,000, and an $M_n$ of from about 25,000 to about 50,000, and preferably about 35,000.

In embodiments, the photogenerating layer is comprised of metal phthalocyanines, metal free phthalocyanines. In embodiments, the photogenerating layer is comprised of titanyl phthalocyanines, perylenes, or hydroxygallium phthalocyanines. In embodiments, photogenerating layer is comprised of Type V hydroxygallium phthalocyanine.

Embodiments of this invention can include a method of imaging which comprises generating an electrostatic latent image on the imaging member, developing the latent image, and transferring the developed electrostatic image to a suitable substrate.

In embodiments of this invention, the undercoating layer is derived from the crosslinking of polymer (III) with silane coupling agents (I) and (II) in the presence of an optional catalyst selected from the group consisting of carboxylic acids and amines. In embodiments of the photoconductive imaging member, acetic acid or an alkylamine is selected as the catalyst to accelerate the curing of its undercoating layer.

In embodiments of this invention, a crosslinked polysiloxane polymer is selected as a hole blocking undercoating layer, and is generated from the reaction of polymer (III) and silane coupling agents (I) and (II).

In embodiments of this invention, a crosslinked polysiloxane undercoating layer is selected.

In embodiments of this invention the imaging members comprise a supporting substrate, a crosslinked undercoating layer; thereover a photogenerating layer of, for example, hydroxygallium phthalocyanine, and a charge transport layer.

Optionally, an overcoat layer can be utilized to improve resistance to abrasion. Also optionally, a back coating may be applied to the side opposite the imaging side of the photoreceptor to provide flatness and/or abrasion resistance. These overcoat and back coat layers can include any suitable composition, such as, for example, organic polymers or inorganic polymers that are electrically insulating or slightly semi-conductive.

Of importance with respect to the present invention is the hole blocking undercoating layer preferably comprised of a crosslinked polysiloxane polymer as schematically represented by formula (IV) derived from the reaction of polymer (III) and silane coupling agents (I) and (II):

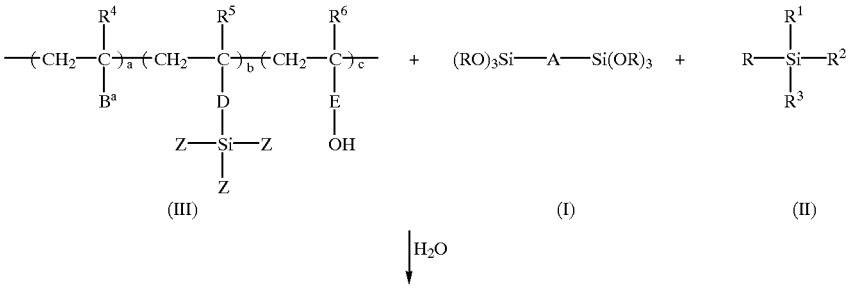

-continued

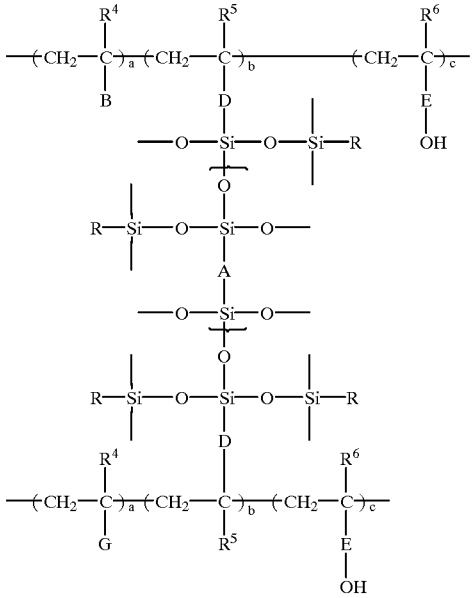

(IV)

While the undercoating layer of this invention can be produced to any suitable thickness, in embodiments of this invention, the undercoating layer is 0.01 to 10 $\mu$m thick, preferably 1 to 5 $\mu$m thick and, more preferably 1 to 2 $\mu$m thick or 3 to 5 $\mu$m thick.

The undercoating layer derived from polymer (III) using silane coupling agent represented in formula (I) provides several advantages. First, (I) is a more efficient silane coupling agent, thus ensuring a faster curing reaction and more complete crosslinking reaction.

Second, the curing rate of the undercoating layer composition is greatly accelerated by the addition of silane coupling agent (I), for example 1,2-bis(triethoxysilyl)ethane, 1,6-bis(trimethoxysilyl)hexane and the like. Both thin (1–2 micrometers) and thick (3–5 micrometers) undercoating layers can be fabricated with curing times that are compatible with conventional slot coating processes (for example, 1 minute at 135° C.) and dip coating process (for example, 20 min at 135° C.–140° C.).

Photoreceptors incorporating these undercoating layers show excellent electrical properties with low dark decay, low voltage residue, and high photosensitivity.

Also, included within the scope of the present invention are methods of imaging and printing with the photoresponsive devices illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of Polymer (III) with a=0.68, b=0.02, and c=0.30):

To a 1 liter three-neck round-bottomed flask, under a nitrogen blanket, are added 20.42 grams of methyl methacrylate, 1.49 grams of 3-(trimethoxysilyl) propyl methacrylate, 11.71 grams of 2-hydroxyethyl methacylate, and 240 milliliters of tetrahydrofuran. The resulting mixture is stirred at about 50° C. for 10 minutes, followed by the addition of 0.394 grams of 2,2'-azobis(isobutyronitrile) initiator. The mixture is subsequently stirred and refluxed for 24 hours. The resulting polymer solution is diluted with about 600 milliliters of tetrahydrofluran at room temperature, about 25° C. throughout, and is then poured into about 5,000 milliliters of hexane with stirring to precipitate the polymer product. The solid product, polymer (III-a), is collected by filtration and dried at room temperature in vacuo for 24 hours to give 30 grains (89.2 percent) of polymer (III-a). The polymer displays an $M_w$ of 29,762 and $M_n$ of 12,537 as measured by GPC and IR (film) absorption of 1,736 (C═O) $cm^{-1}$, and 3467(OH).

EXAMPLE II

Synthesis of Polymer (III) with a=0.48. b=0.02. and c=0.50):

The polymer is prepared in accordance with the procedure of Example I except that 24.03 grains of methyl methacrylate, 2.48 grams of 3-(trimethoxysilyl) propyl methacrylate, 32.54 grams of 2-hydroxyethyl methacylate, 385 milliliters of tetrahydrofuran, and 0.63 grams of 2,2'-azobis(isobutyronitrile) initiator are utilized. The yield is 55 grams (93.1 percent).

The polymer displays an $M_w$ of 33,358 and $M_n$ of 13,138 as measured by GPC and IR (film) absorption of 1,735 $cm^{-1}$ (C═O) and 34678 $cm^{-1}$ (OH).

EXAMPLE III

An illustrative photoresponsive imaging device incorporating the blocking layer of the present invention is fabricated as follows.

On a 75-micron thick titanized MYLAR® substrate is coated by draw bar technique with a hole blocking layer from a solution of 1.0 grams of polymer (III) of Example I, 0.25 grams of 1,2-bis(triethoxysilyl)ethane and 0.75 grams of 3-aminopropyltriethoxysilane in 8.0 grams of a 80.0/13.8/6.25 (by weight %) mixture of ethanol/water/acetic acid. After drying at 135° C. to 1 40° C. for 1 minute, a hole blocking layer (HBL) of 2.5 to 3.0 microns thickness is obtained. Overcoated on the top of the blocking layer is a 0.05 micron thick adhesive layer prepared from a solution of 2 weight percent of a DuPont 49K polyester in dichloromethane. A 0.2 micron photogenerating layer is subsequently coated on top of the adhesive layer from a dispersion of hydroxy gallium phthalocyanine Type V (0.46 gram) and a polystyrene-b-polyvinylpyridine block copolymer (0.48 gram) in 20 grams of toluene, followed by drying at 100° C. for 10 minutes. Subsequently, a 25-micron charge transport layer (CTL) is coated on top of the photogenerating layer from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

A control device is also prepared in a similar manner except that the hole blocking layer is 0.05 micron thick comprised from 3-aminopropyltrimethoxysilane.

The xerographic electrical properties of the imaging members can be determined by known means, including as indicated herein by electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attain a surface potential of $V_{ddp}$, dark development potential. Each member is then exposed to light from a filtered Xenon lamp with a XBO 150 watt bulb, thereby inducing a photodischarge that results in a reduction of surface potential to a $V_{bg}$ value, background potential. The percent of photodischarge is calculated as $100\times(V_{ddp}-V_{bg})V_{ddp}$. The desired wavelength and energy of the exposed light is determined by the type of filters placed in front of the lamp. The monochromatic light photosensitivity is determined using a narrow band-pass filter.

The following table summarizes the electrical performance of these devices, showing the effective blockage of charge injection by the hole blocking layer (HBL) of the present invention. Specifically, while the dark development potential ($V_{ddp}$), the half discharge exposure energy ($E_{1/2}$), and the residual voltage are similar for the control device and the device of the present invention, the dark decay, which measures the dark conductivity related to hole injection into the photogenerator layer, of the device of the present invention is significantly lower than that of the control device.

| Device # | CTL (μm) | Vddp (V) | E½ ergs/cm² | Dark Decay (V @ 500 ms) | Vr (V) |
|---|---|---|---|---|---|
| Control Device Without UCL | 25.0 | 813 | 1.54 | 19.5 | 0–4 |
| Device with 2.5–3.0 μm Crosslinked polysiloxane UCL | 24.5 | 805 | 1.35 | 7.4 | 0–3 |

EXAMPLE IV

Another photoresponsive imaging device with a hole blocking layer of the present invention is fabricated in accordance to the procedure of Example III except that the relative amount of 3-aminopropyltrimethoxysilane to 1,2-bis(triethoxysilyl)ethane and solvent compositions is different. The blocking layer is prepared from a solution of 1.0 grams of polymer (III) of Example I, 0.1 grams of 1,2-bis(triethoxysilyl)ethane and 0.9 grams of 3-aminopropyltrimethoxysilane in 8.0 grams of a 62.5/25.0/12.5 (by weight %) mixture of ethanol/water/acetic acid. HBL thickness is about 2.5 to 3.0 microns. After drying at 135° C. to 140° C. for 1 minute a hole blocking layer (HBL) of 2.5 to 3.0 microns thickness is obtained. The following table summarizes the electrical performance of this device:

| Device # | CTL (μm) | Vddp (V) | E½ ergs/cm² | Dark Decay (V @ 500 ms) | Vr (V) |
|---|---|---|---|---|---|
| Control Device Without UCL | 25.0 | 813 | 1.54 | 19.5 | 0–4 |
| Device with 2.5–3.0 μm Crosslinked polysiloxane UCL | 26.5 | 805 | 1.49 | 9.7 | 0–4 |

EXAMPLE V

Another photoresponsive imaging device with a hole blocking layer of the present invention is fabricated in accordance with the procedure of Example IV from the same coating solution, except that the photoresponsive imaging device with a hole blocking layer is derived from a nine-day old coating solution instead of the fresh coating solution. After drying at 135° C. to 140° C. for 1 minute a blocking layer with a thickness of about 2.5 to 3.0 microns is obtained. The following table summarizes the electrical performance of this device:

| Device # | CTL (μm) | Vddp (V) | E½ ergs/cm² | Dark Decay (V @ 500 ms) | Vr (V) |
|---|---|---|---|---|---|
| Control Device Without UCL | 25.0 | 813 | 1.54 | 19.5 | 0–4 |
| Device with 2.5–3.0 μm Crosslinked polysiloxane UCL | 24.9 | 806 | 1.45 | 8.1 | 0–5 |

While this invention has been described in conjunction with specific embodiments described above, it is evident that many alternatives, modifications and variations will be apparent to those skilled in the art.

Accordingly, the preferred embodiments of the invention, as set forth above, are intended to be illustrative and not limiting. Various changes may be made without departing from the spirit and scope of the invention.

What is claimed is:

1. An electrophotographic imaging member, comprising:

a substrate;

an undercoating layer formed over the substrate; and a photosensitive layer formed over the undercoating layer;

wherein the undercoating layer is derived from crosslinking a silyl-functionalyzed hydroxyalkyl acrylate or methacrylate polymer (I) with a silane coupling agent (I) and optionally a silane coupling agent (II) and optionally in the presence of a crosslinking agent $$(RO)_3Si—A—Si(OR)_3 \quad (I)$$

(II)

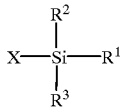

(III)

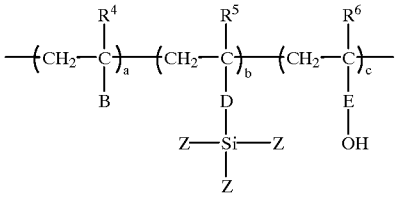

wherein:

R is selected from the group consisting of alkyl, substituted alkyl, aryl, substituted aryl, and acyl groups, each having from about 1 to 24 carbon atoms;

A is a divalent linkage;

X is selected from the group consisting of an alkyl, a substituted alkyl, an aryl, and a substituted aryl group;

$R^1$, $R^2$, and $R^3$ are independently selected from the group consisting of an alkyl, an aryl, an alkoxy, an aryloxy, an acyloxy, a halide, a cyano, and an amino group, provided that at least two of the $R^1$, $R^2$, and $R^3$ are selected from the group consisting of alkoxy, aryloxy, acyloxy, halide, cyano, and amino groups;

$R^4$, $R^5$, and $R^6$ are selected from the group consisting of hydrogen and an alkyl group;

Z is a hydrolyzable functional group;

B is selected from the group consisting of halide, cyano, aryl, alkoxycarbonyl and aryloxycarbonyl groups;

D is a divalent linkage selected from the group consisting of alkyleneoxycarbonyl, arylene, alkylenearyl, aryleneoxycarbonyl, and alkylenearyloxycarbonyl;

E is a divalent linkage selected from the group consisting of alkyleneoxycarbonyl, and alkylenearyloxycarbonyl; and a, b, and c are the mole fractions of the repeating units of the polymer, such that a+b+c=1.

2. The electrophotographic imaging member of claim 1 wherein A is a divalent linkage selected from the group consisting of an alkylene, an arylene, and an alkylenearyl group containing from about 1 to about 24 carbon atoms.

3. The electrophotographic imaging member of claim 1 wherein Z is a hydrolyzable functional group selected from the group consisting of chloride, bromide, iodine, cyano, alkoxy, and acyloxy groups.

4. The electrophotographic imaging member of claim 1 wherein R in formula (I) is alkyl and A is alkylene.

5. The electrophotographic image member of claim 1 wherein said silane coupling agent is a bis(trialkoxysilyl)-containing compound.

6. The electrophotographic imaging member of claim 5, wherein the undercoating layer is 1 to 2 $\mu$m thick.

7. The electrophotographic image member of claim 1 wherein said silane coupling agent (I) is bis(trialkoxysilyl) alkane.

8. The electrophotographic imaging member of claim 1 wherein said silane coupling agent (I) is 1,2-bis (triethoxysilyl)ethane.

9. The electrophotographic imaging member of claim 1, wherein the undercoating layer is 0.01 to 5 $\mu$m thick.

10. The electrophotographic imaging member of claim 9, wherein the undercoating layer is 3 to 5 $\mu$m thick.

11. The electrophotographic imaging member of claim 1, further comprising an adhesive layer in between the undercoating layer and the photosensitive layer.

12. The electrophotographic imaging member of claim 11, wherein said photosensitive layer comprises a charge generating layer and a charge transport layer.

13. The electrophotographic imaging member of claim 1 wherein said silane coupling agent (II) is present and comprises γ-aminopropylsilane.

14. The electrophotographic imaging member of claim 1, wherein the undercoating layer is derived from silyl-funtionalyzed polymer selected from the group consisting of (IIIa) through (IIIh):

(III-a)

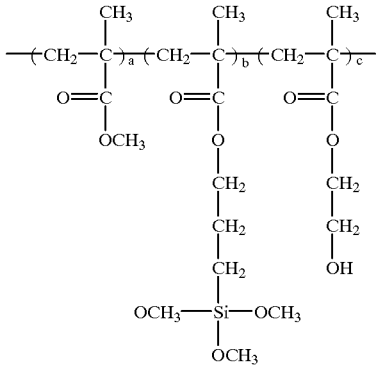

(III-b)

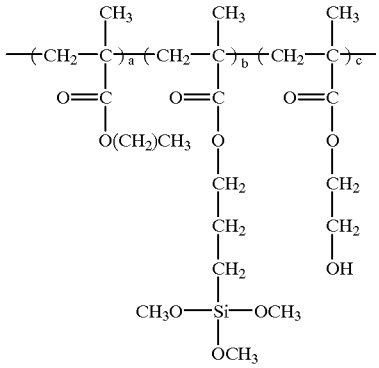

(III-c)

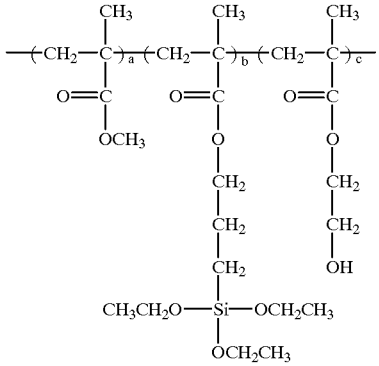

-continued (III-d)

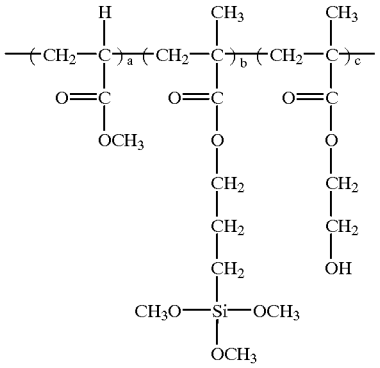

(III-e)

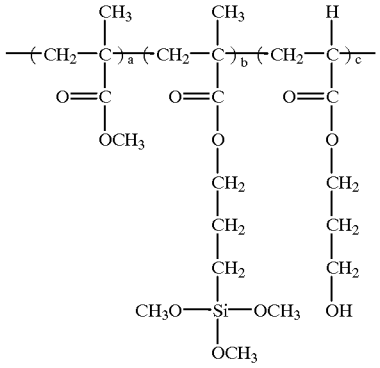

(III-f)

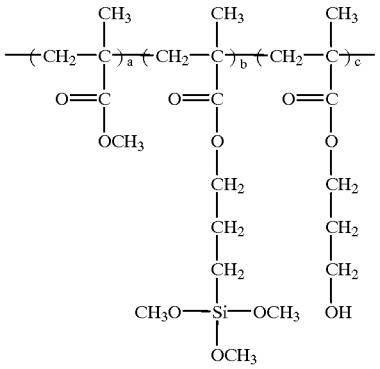

(III-g)

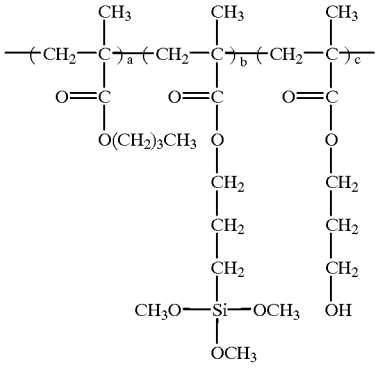

-continued (III-h)

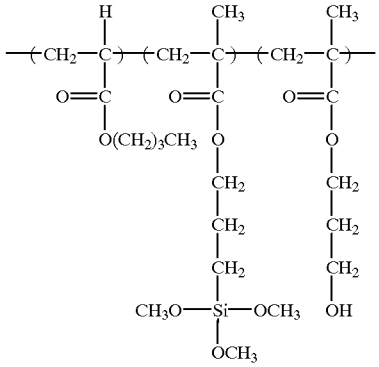

wherein a, b, and c each ranges from about 0 to about 0.95 such that a+b+c=1.0.

15. A method of preparing an electrophotographic imaging member, comprising:

forming an undercoating layer over a substrate;

forming a photosensitive layer over the undercoating layer;

wherein the undercoating layer is derived from crosslinking of a silyl-functionalyzed hydroxyalkyl acrylate or methacrylate polymer (III) with a mixture of silane coupling agents comprising silane agents (I) and (II)

$$(RO)_3Si—A—Si(OR)_3 \quad (I)$$

(II)

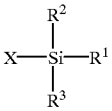

(III)

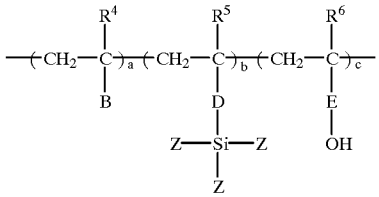

wherein:

R is selected from the group consisting of alkyl, substituted alkyl, aryl, substituted aryl, and acyl groups, each having from about 1 to 24 carbon atoms;

A is a divalent linkage;

X is selected from the group consisting of an alkyl, a substituted alkyl, an aryl, and a substituted aryl group;

$R^1$, $R^2$, and $R^3$ are independently selected from the group consisting of an alkyl, an aryl, an alkoxy, an aryloxy, an acyloxy, a halide, a cyano, and an amino group, provided that at least two of the $R^1$, $R^2$, and $R^3$ are selected from the group consisting of alkoxy, aryloxy, acyloxy, halide, cyano, and amino groups;

$R^4$, $R^5$, and $R^6$ are selected from the group consisting of hydrogen and an alkyl group;

Z is a hydrolyzable functional group;

B is selected from the group consisting of halide, cyano, aryl, alkoxycarbonyl and aryloxycarbonyl groups;

D is a divalent linkage selected from the group consisting of alkyleneoxycarbonyl, arylene, alkylenearyl, aryleneoxycarbonyl, and alkylenearyloxycarbonyl;

E is a divalent linkage selected from the group consisting of alkyleneoxycarbonyl, and alkylenearyloxycarbonyl; and a, b, and c are the mole fractions of the repeating units of the polymer, such that a+b+c=1.

16. The method of preparing an electrophotographic imaging member of claim 15 wherein said silane agent (I) is 1,2-bis(trimethoxysilyl)ethane and silane agent (II) is γ-aminopropyltrimethoxysilane.

17. The method of preparing an electrophotographic imaging member of claim 15 wherein said silane agent (I) is 1,2-bis(triethoxysilyl)ethane.

18. The method of preparing an electrophotographic imaging member of claim 15, wherein the undercoating layer is 1 to 5 μm thick.

19. The method of preparing an electrophotographic imaging member of claim 15 wherein said undercoating layer is fabricated by a slot-coating process.

20. The method of preparing an electrophotographic imaging member of claim 19 wherein said undercoating layer on the substrate is cured for about 1 minute at a coating temperature of about 135° C.

21. The method of preparing an electrophotographic imaging member of claim 15 wherein said undercoating layer on a substrate is fabricated by a dip coating process.

22. The method of preparing an electrophotographic imaging member of claim 21 wherein said undercoating layer on the substrate is cured for about 20 minutes at a coating temperature of about 135° C.

* * * * *